US011102571B2

(12) United States Patent
Usui et al.

(10) Patent No.: US 11,102,571 B2
(45) Date of Patent: Aug. 24, 2021

(54) SPEAKER POSITION DETERMINATION METHOD, SPEAKER POSITION DETERMINATION SYSTEM, AND AUDIO APPARATUS

(71) Applicant: Yamaha Corporation, Hamamatsu (JP)

(72) Inventors: Atsushi Usui, Hamamatsu (JP); Kotaro Nakabayashi, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 16/502,782

(22) Filed: Jul. 3, 2019

(65) Prior Publication Data

US 2020/0015002 A1 Jan. 9, 2020

(30) Foreign Application Priority Data

Jul. 5, 2018 (JP) ..... JP2018-128159

(51) Int. Cl.
*H04R 29/00* (2006.01)
*H04R 1/32* (2006.01)
*H04R 1/22* (2006.01)

(52) U.S. Cl.
CPC ..... *H04R 1/323* (2013.01); *H04R 1/227* (2013.01); *H04R 2201/40* (2013.01); *H04R 2203/12* (2013.01); *H04R 2430/23* (2013.01)

(58) Field of Classification Search
CPC ..... H04R 5/02; H04R 5/04; H04R 29/001; H04S 7/30; H04S 7/301
See application file for complete search history.

(56) References Cited

U.S. PATENT DOCUMENTS 7,428,310 B2 * 9/2008 Park ..... H04S 7/301 381/104
7,864,361 B2 * 1/2011 Silverbrook ..... B41J 2/04543 358/1.3
7,864,631 B2 * 1/2011 Van Leest ..... H04S 7/301 367/124
7,933,418 B2 * 4/2011 Morishima ..... H04R 5/02 381/105
8,199,941 B2 * 6/2012 Hudson ..... H04S 7/00 381/27
9,332,371 B2 * 5/2016 De Bruijn ..... H04S 7/301
9,377,941 B2 * 6/2016 Nguyen ..... G06T 7/55
9,426,598 B2 * 8/2016 Walsh ..... H04S 7/301
(Continued)

FOREIGN PATENT DOCUMENTS

WO WO 2008/126161 A1 10/2008

*Primary Examiner* — Ryan Robinson
(74) *Attorney, Agent, or Firm* — Crowell & Moring LLP

(57) ABSTRACT

A speaker position determination system includes a server, wherein the server includes: a processor configured to: acquire a first reproduction sound output from a first speaker and a second reproduction sound output from a second speaker at the same timing as the first reproduction sound, which are picked up by a sound pickup device arranged at a position of a speaker to be determined; calculate a first time lag indicating a time lag from an output timing of the first reproduction sound until a pickup timing of the first reproduction sound and a second time lag indicating a time lag from an output timing of the second reproduction sound until a pickup timing of the second reproduction sound; and determine the position of the speaker based on the first time lag and the second time lag.

19 Claims, 7 Drawing Sheets

(56) References Cited

U.S. PATENT DOCUMENTS

| | | | | |
|---|---|---|---|---|
| 9,538,309 | B2 * | 1/2017 | Nielsen | H04R 5/02 |
| 9,794,692 | B2 * | 10/2017 | Bhogal | H04R 5/04 |
| 9,826,332 | B2 * | 11/2017 | Milne | H04S 7/302 |
| 10,523,171 | B2 * | 12/2019 | Wardle | H04S 7/30 |
| 2006/0083391 | A1 * | 4/2006 | Nishida | H04S 7/301 381/96 |
| 2011/0211705 | A1 * | 9/2011 | Hutt | H04R 29/001 381/59 |
| 2020/0084547 | A1 * | 3/2020 | Yoshida | H04R 3/00 |

* cited by examiner

SPEAKER POSITION DETERMINATION METHOD, SPEAKER POSITION DETERMINATION SYSTEM, AND AUDIO APPARATUS

CROSS-REFERENCE TO RELATED APPLICATION

The present application claims priority from Japanese application JP 2018-128159 filed on Jul. 5, 2018, the content of which is hereby incorporated by reference into this application.

BACKGROUND OF THE INVENTION

1. Field of the Invention

The present disclosure relates to a speaker position determination method, a speaker position determination system, and an audio apparatus.

In WO 2008/126161 A1, there is disclosed a multi-channel reproduction system including a plurality of speakers. In the multi-channel reproduction system disclosed in WO 2008/126161 A1, an impulse measurement sound is output from a plurality of speakers in order one by one, and the output sound is picked up at a plurality of positions, to thereby determine positions of the plurality of speakers. Once the positions of the speakers are identified, channels of a reproduction sound can be correctly assigned to the respective speakers.

However, in the above-mentioned related-art configuration, it is required to pick up a sound output from a speaker at a plurality of positions having known relative positions in order to determine a position of the speaker, and hence there is a problem in that the structure of a sound pickup device becomes more complicated.

SUMMARY OF THE INVENTION

The present disclosure has been made in view of the above-mentioned background, and has an object to determine a position of a speaker with a simple structure of a sound pickup device.

According to at least one embodiment of the present disclosure, there is provided a speaker position determination method including: acquiring a first reproduction sound output from a first speaker and a second reproduction sound output from a second speaker at the same timing as the first reproduction sound, which are picked up by a sound pickup device arranged at a position of a speaker to be determined; calculating a first time lag indicating a time lag from an output timing of the first reproduction sound until a pickup timing of the first reproduction sound and a second time lag indicating a time lag from an output timing of the second reproduction sound until a pickup timing of the second reproduction sound; and determining the position of the speaker based on the first time lag and the second time lag.

According to at least one embodiment of the present disclosure, there is provided a speaker position determination system including a server, wherein the server includes: a processor configured to: acquire a first reproduction sound output from a first speaker and a second reproduction sound output from a second speaker at the same timing as the first reproduction sound, which are picked up by a sound pickup device arranged at a position of a speaker to be determined; calculate a first time lag indicating a time lag from an output timing of the first reproduction sound until a pickup timing of the first reproduction sound and a second time lag indicating a time lag from an output timing of the second reproduction sound until a pickup timing of the second reproduction sound; and determine the position of the speaker based on the first time lag and the second time lag.

According to at least one embodiment of the present disclosure, there is provided an audio apparatus including: a processor configured to: acquire a first reproduction sound output from a first speaker and a second reproduction sound output from a second speaker at the same timing as the first reproduction sound, which are picked up by a sound pickup device arranged at a position of a speaker to be determined; calculate a first time lag indicating a time lag from an output timing of the first reproduction sound until a pickup timing of the first reproduction sound and a second time lag indicating a time lag from an output timing of the second reproduction sound until a pickup timing of the second reproduction sound; and determine the position of the speaker based on the first time lag and the second time lag.

DETAILED DESCRIPTION OF THE INVENTION

DETAILED DESCRIPTION OF THE INVENTION

Figure 1:
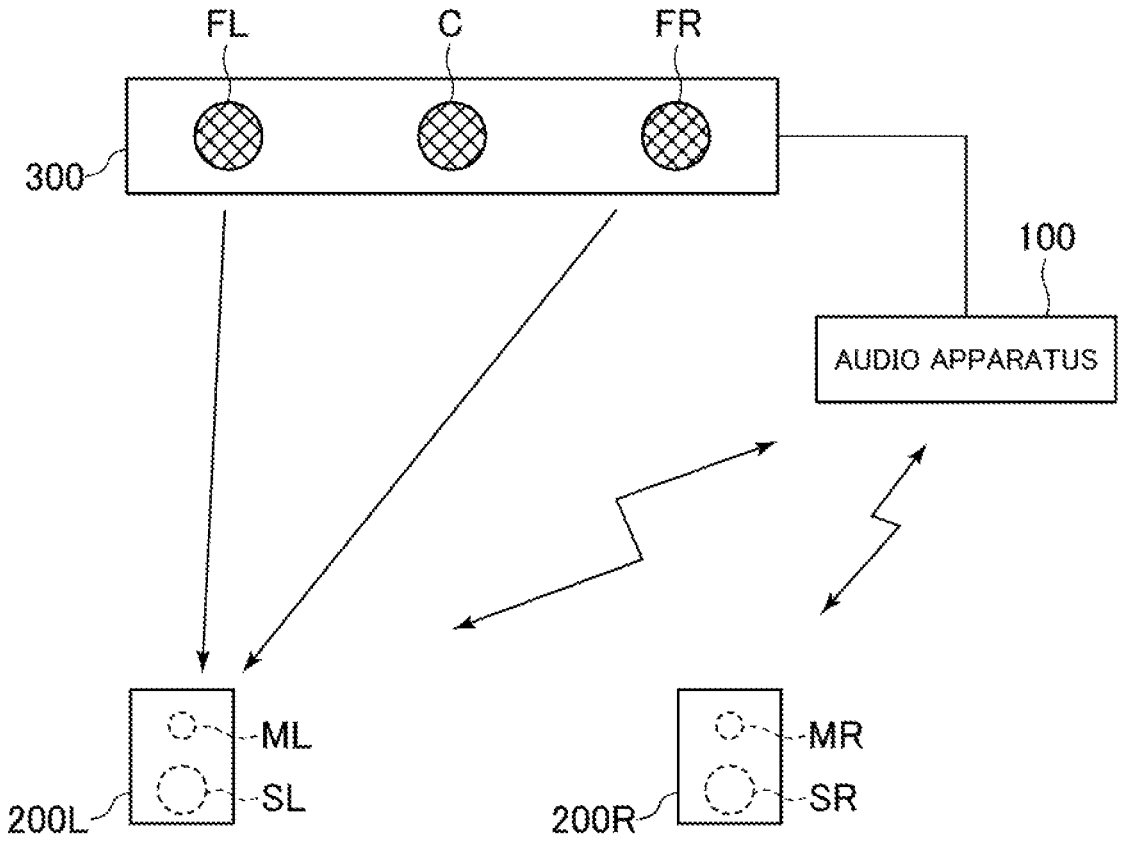
FIG. 1 is a schematic diagram for illustrating a layout example of speakers in a room.

FIG. 1 is a schematic diagram for illustrating an audio-visual (AV) system including a speaker position determination system according to at least one embodiment of present disclosure. The AV system is installed in an AV listening-and-viewing space in a home, and includes an audio apparatus 100, for example, an AV receiver, and a left front speaker FL, a right front speaker FR, a center speaker C, a left surround speaker SL, and a right surround speaker SR, which are connected to the audio apparatus 100. The audio apparatus 100 may be connected to a subwoofer or other such speaker.

A listener (not shown) is positioned in a central vicinity of the listening-and-viewing space, and those speakers are arranged around the listener. In this case, the left front speaker FL is set on a left front side of the listener, the right front speaker FR is set on a right front side of the listener, and the center speaker C is set at a center on a front side of the listener. The left front speaker FL, the right front speaker FR, and the center speaker C may be separate individual speakers, but is formed as a sound bar 300 being a unitary speaker unit. The sound bar 300 and the audio apparatus 100 may be provided as a unitarily formed apparatus.

In addition, the left surround speaker SL is set on a left rear side of the listener, and the right surround speaker SR is set on a right rear side of the listener. In this case, the left surround speaker SL is contained in a common housing together with a microphone ML to be unitarily formed as a speaker unit 200L. In the same manner, the right surround speaker SR is contained in a common housing together with a microphone MR to be unitarily formed as a speaker unit 200R. In this example, the microphone ML is formed unitarily with the left surround speaker SL, but it is to be understood that the microphone ML may be provided separately from the left surround speaker SL. In this case, the microphone ML is arranged closely to the left surround speaker SL. In the same manner, the microphone MR may be provided separately from the right surround speaker SR, and in that case, may be arranged closely to the right surround speaker SR.

The speaker units 200L and 200R may be, for example, various smart speakers, and may be of a type that allows the listener to operate the audio apparatus 100 or other such apparatus by voice. In this case, the microphones ML and MR provided in the speaker units 200L and 200R are used to pick up sounds output from the left front speaker FL and the right front speaker FR in order to determine the positions of the speaker units 200L and 200R. The microphones ML and MR may be omnidirectional in order to equally pick up the sounds output from the left front speaker FL and the right front speaker FR, which are arranged so as to be spaced apart from each other.

The audio apparatus 100 includes speaker terminals corresponding to the respective plurality of channels. Of the above-mentioned five speakers, the left front speaker FL, the right front speaker FR, and the center speaker C are connected to the corresponding speaker terminals. Sound signals of mutually different sound channels included in one piece of video, music, or other such content are sent to those speakers from the audio apparatus 100, and the respective speakers output the sounds of the corresponding channels.

In addition, the speaker units 200L and 200R are connected to the audio apparatus 100 through data communication using a wired LAN or a wireless LAN. In the above-mentioned case, in which the sound bar 300 and the audio apparatus 100 are provided as a unitarily formed apparatus, the speaker units 200L and 200R are connected to the unitarily formed apparatus through data communication using a wired LAN or a wireless LAN. Pieces of data on sound signals of sound channels assigned to the speaker units 200L and 200R, which are included in one piece of content of video or music, are wirelessly transmitted from the audio apparatus 100 to the speaker units 200L and 200R as well, and the left surround speaker SL and the right surround speaker SR output sounds of their corresponding channels. The audio apparatus 100 is configured to measure in advance a communication time period from the audio apparatus 100 to each of the speaker units 200L and 200R, and control a timing to emit a sound from each of the speaker units 200L and 200R and the sound bar 300 based on the measured communication time period. This allows the above-mentioned five speakers to synchronously output sounds of a plurality of channels included in one piece of content.

In at least one embodiment of the present disclosure, the audio apparatus 100 determines the position of the speaker unit 200L particularly based on data on a sound recorded by the microphone ML and data on sounds of a left front channel FL and a right front channel FR included in reproduction content. The audio apparatus 100 similarly determines the position of the speaker unit 200R. That is, the audio apparatus 100 includes a speaker position determination system according to at least one embodiment of the present disclosure. A description is given herein of the determination of the positions of the speaker units 200L and 200R, but the speaker position determination system and a method therefor according to at least one embodiment of the present disclosure may be employed for the determination of the position of another speaker in the same manner.

Now, a basic idea of speaker position determination processing in at least one embodiment of the present disclosure is described by taking an exemplary case of the speaker unit 200L. In the speaker position determination processing, the sounds of the left front channel FL and the right front channel FR are output from the left front speaker FL and the right front speaker FR, respectively. It is preferred in the speaker position determination processing that the sounds of the other channels have output volumes suppressed or are inhibited from being output.

Figures 2A, 2B, 2C:
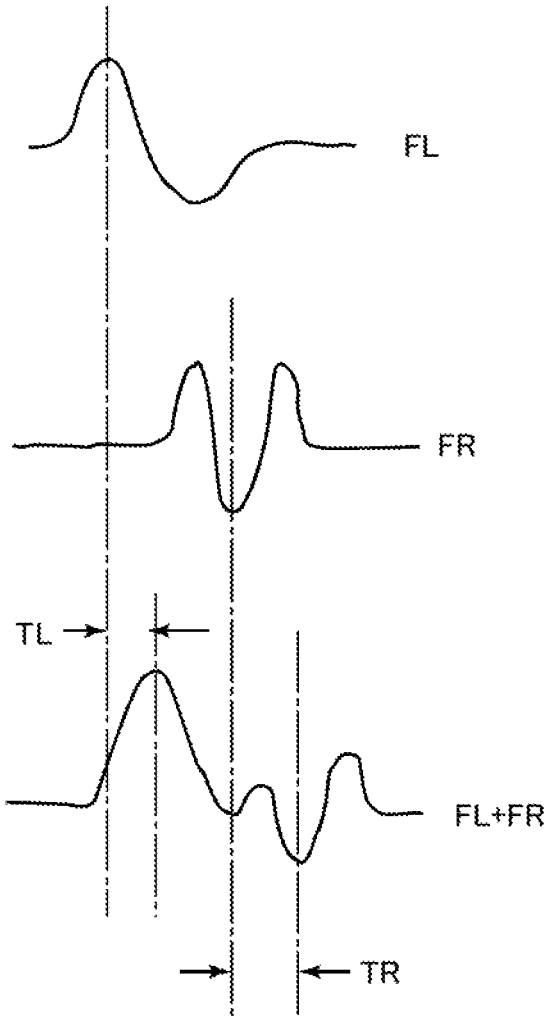
FIGS. 2A to 2C are diagrams for illustrating waveforms of (a) a sound output from a left front speaker, (b) a sound output from a right front speaker and (c) a mixed sound picked up by a microphone.

Therefore, when a sound output from the left front speaker FL has a waveform illustrated in FIG. 2(*a*) and a sound output from the right front speaker FR at the same timing has a waveform illustrated in FIG. 2(*b*), a sound picked up by the microphone ML has a waveform illustrated in FIG. 2(*c*). That is, the microphone ML picks up a mixed sound of the sound output from the left front speaker FL and the sound output from the right front speaker FR.

In this case, when the speaker unit 200L is correctly arranged on the left side behind the listener as described above, a distance from the left front speaker FL to the microphone ML is shorter than a distance from the right front speaker FR to the microphone ML. For this reason, the sound output from the left front speaker FL reaches the microphone ML earlier than the sound output from the right front speaker FR. Therefore, assuming that, as illustrated in FIG. 2(*c*), the mixed sound acquired by the microphone ML includes the sound of the left front channel FL with a time lag TL and the sound of the right front channel FR with a time lag TR, the time lag TL is shorter than the time lag TR. In contrast, when the speaker unit 200L is erroneously arranged on the right side behind the listener, the time lag TL is longer than the time lag TR.

In order to obtain the time lag TL, the speaker position determination processing in at least one embodiment of the present disclosure involves detecting at which timing data FL on the sound of the left front channel FL is included in pickup sound data obtained by the microphone ML. Therefore, a shift amount between positions of the pickup sound data and the data FL, which maximizes a similarity degree therebetween, is calculated. For example, $\tau$ that gives a maximum value of a cross-correlation function of the data FL and the pickup sound data (convolution integral of the two pieces of data, where one of the two pieces is shifted from another by a variable $\tau$) may be set as the time lag TL. The time lag TR is acquired in the same manner. When the time lag TL is shorter than the time lag TR, it is determined that the speaker unit 200L is arranged on the left side behind the listener.

Figure 3:
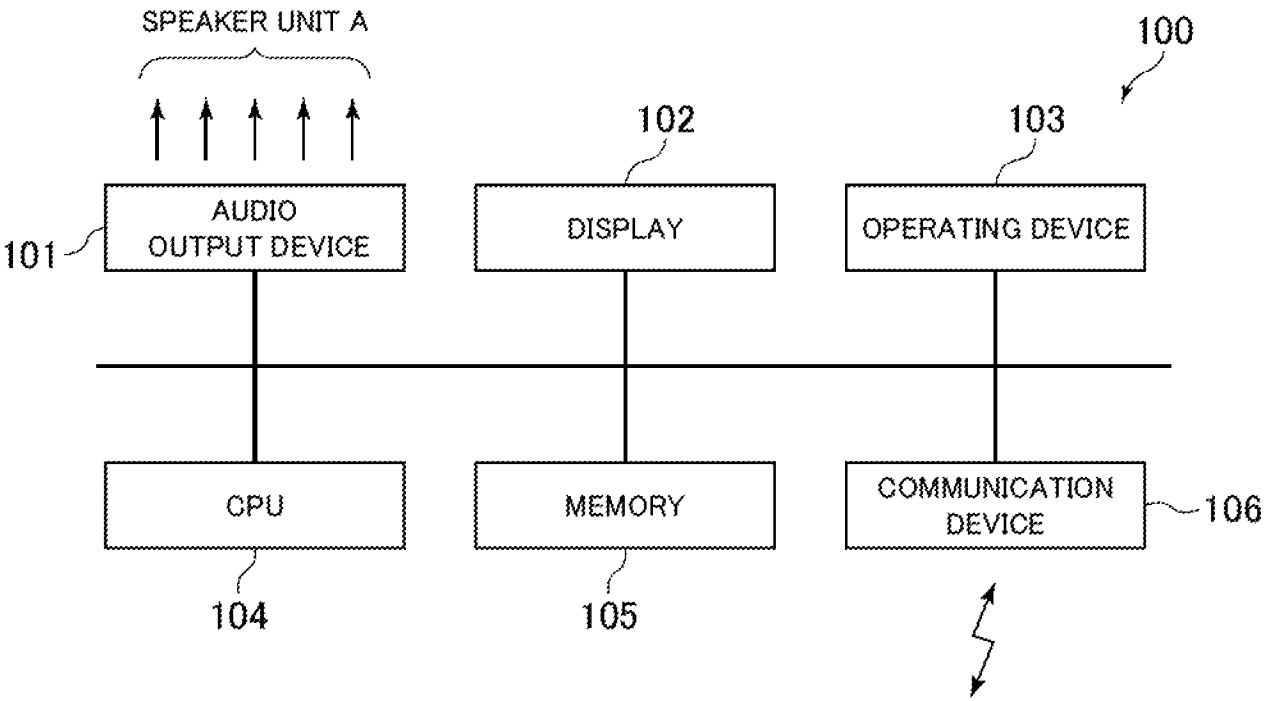
FIG. 3 is a diagram for illustrating a hardware configuration example of an audio apparatus.

FIG. 3 is a diagram for illustrating a hardware configuration of the audio apparatus 100. As illustrated in FIG. 3, the audio apparatus 100 includes an audio output device 101, a display 102, an operating device 103, a CPU 104, a memory 105, and a communication device 106, which are connected to a bus. That is, the audio apparatus 100 includes the CPU 104 and the memory 105, and functions as a computer.

The audio output device 101 reads content from a CD, a DVD, a Blu-ray disc, or other such medium, or receives content via the communication device 106, and reproduces the content acquired in this manner. At this time, the audio output device 101 converts sound data on a plurality of channels included in the acquired content into sound signals, and outputs the sound signals from the speaker terminals of the respective channels. In addition, for each of the speaker units 200L and 200R and other such apparatus configured to communicate data to/from the audio apparatus 100, the audio output device 101 converts a sound of each channel into data to cause the communication device 106 to transmit the data to the apparatus.

The display 102 includes a liquid crystal display (LCD), an organic light emitting diode (OLED), or other such display device, and displays various kinds of information based on an instruction received from the CPU 104. The operating device 103 is provided with a physical key or a touch panel, and is used by the listener to operate the audio apparatus 100.

The CPU 104 controls the respective components of the audio apparatus 100 based on a built-in program. In particular, the CPU 104 performs the above-mentioned speaker position determination processing based on the built-in program. The memory 105 stores the built-in program, or reserves a work area for the CPU 104. The communication device 106 includes a communication module for, for example, a wired LAN or a wireless LAN, and is used to communicate to/from the speaker units 200L and 200R or to receive content and other such data via the Internet. For example, the built-in program may be downloaded from the Internet through use of the communication device 106, or may be installed from a semiconductor memory or other such external storage medium.

Figure 4:
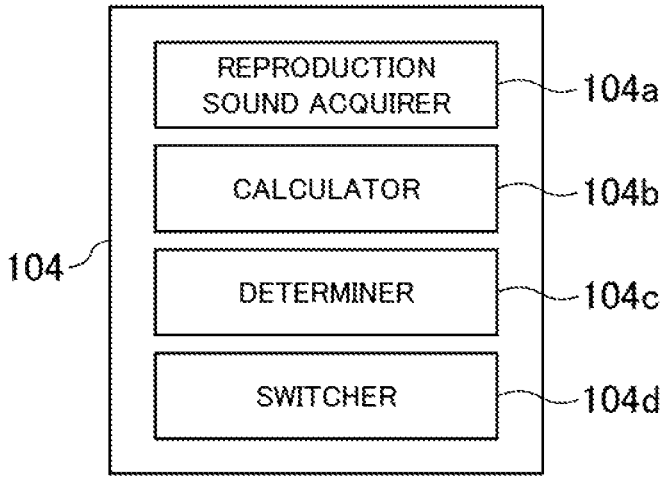
FIG. 4 is a block diagram for functionally illustrating a CPU included in the audio apparatus.

FIG. 4 is a block diagram for functionally illustrating the CPU 104 included in the audio apparatus 100. In FIG. 4, only functions relating to the speaker position determination processing among different kinds of functions implemented by the CPU 104 are illustrated. The functions illustrated in FIG. 4 are implemented by the CPU 104 executing the built-in program stored in the memory 105.

A reproduction sound acquirer 104*a* uses the communication device 106 to acquire, from the speaker unit 200L and the speaker unit 200R, a content reproduction sound output from the left front speaker FL and a content reproduction sound output from the right front speaker FR, which are picked up by the microphone ML and the microphone MR arranged at the positions of the left surround speaker SL and the right surround speaker SR to be determined.

The reproduction sound acquirer 104*a* may instruct the audio output device 101 to mute the sounds of the channels corresponding to the speaker unit 200L and the speaker unit 200R so as to inhibit the sounds from being emitted therefrom while the sounds are being picked up by the microphone ML and the microphone MR. In the same manner, the reproduction sound acquirer 104*a* may instruct the audio output device 101 to mute the sound of the center channel so as to inhibit the sound from being emitted from the center speaker C while the sounds are being picked up by the microphone ML and the microphone MR. With this configuration, it is possible to prevent a sound other than the sounds of the left front channel FL and the right front channel FR from entering the microphone ML and the microphone MR, and hence it is possible to improve accuracy in determination.

A calculator 104*b* calculates the time lag TL from an output timing of the reproduction sound at the left front speaker FL until a pickup timing of the reproduction sound at the microphone ML or the microphone MR. The calculator 104*b* also calculates the time lag TR from an output timing of the reproduction sound from the right front speaker FR until a pickup timing of the reproduction sound at the microphone ML or the microphone MR. Specifically, the calculator 104*b* calculates the time lag TL corresponding to the maximum value of the cross-correlation function of data on the mixed sound acquired by the microphone ML or the microphone MR and data on the reproduction sound of the left front channel FL. The calculator 104*b* also calculates the time lag TR corresponding to the maximum value of the cross-correlation function of the data on the mixed sound acquired by the microphone ML or the microphone MR and data on the reproduction sound of the right front channel FR.

A determiner 104*c* determines the positions of the speaker units 200L and 200R based on the time lags TL and TR. For example, the determiner 104*c* compares the time lag TL and the time lag TR, which have been calculated from the pickup sound data acquired by the microphone ML, and when the time lag TL is shorter than the time lag TR, determines that the speaker unit 200L is closer to the left front speaker FL than to the right front speaker FR, that is, the speaker unit 200L is arranged on the left side behind the listener.

A switcher 104*d* switches between the sound to be output from the left surround speaker SL and the sound to be output from the right surround speaker SR based on the positions of the speaker units 200L and 200R. Specifically, when the determiner 104*c* determines that the speaker unit 200L is arranged on the right side behind the listener and the speaker unit 200R is arranged on the left side behind the listener, a right surround channel SR is assigned to the left surround speaker SL, and a left surround channel SL is assigned to the right surround speaker SR. With this configuration, it is possible to achieve an appropriate sound field without requiring a user to change installation positions of the speaker units 200L and 200R or requiring the user to change the channels of the sounds output from the speaker units 200L and 200R.

Figure 5:
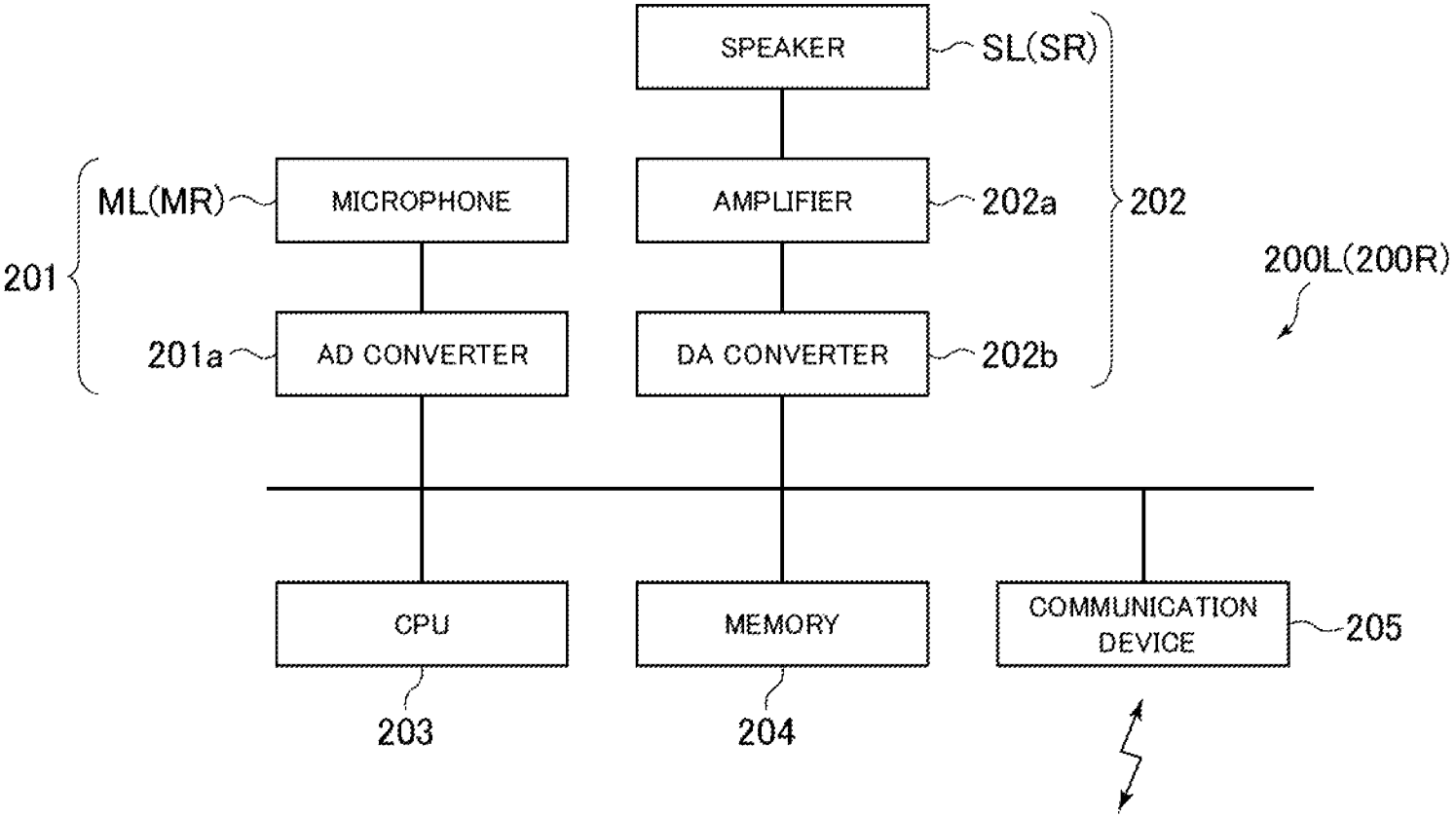
FIG. 5 is a diagram for illustrating a hardware configuration of each speaker unit.

FIG. 5 is a diagram for illustrating a hardware configuration of each of the speaker units 200L and 200R. The speaker units 200L and 200R have the same hardware configuration, and each include a sound pickup section 201, a sound emitting section 202, a CPU 203, a memory 204, and a communication device 205, which are each connected to a bus. That is, the speaker units 200L and 200R each include the CPU 203 and the memory 204 to function as a computer.

The CPU 203 controls the respective components of each of the speaker units 200L and 200R based on a built-in program. The memory 204 stores the built-in program, or reserves a work area for the CPU 203. The communication device 205 includes a communication module for, for example, a wired LAN or a wireless LAN, and is used to communicate to/from the audio apparatus 100 and to receive content and other such data via the Internet. For example, the built-in program may be downloaded from the Internet through use of the communication device 205, or may be installed from a semiconductor memory or other such external storage medium.

The sound pickup section 201 includes an AD converter 201*a* and the microphone ML (MR). An analog electric signal of the mixed sound acquired by the microphone ML or the microphone MR is converted by the AD converter 201*a* into digital data to be passed to the CPU 203 through the bus. Then, the data on the mixed sound is transmitted to the audio apparatus 100 by the communication device 205.

The sound emitting section 202 includes the left surround speaker SL (right surround speaker SR), an amplifier 202*a*, and a DA converter 202*b*. The sound data received from the audio apparatus 100 by the communication device 205 is converted into an analog electric signal by the DA converter 202*b*, and is then amplified by the amplifier 202*a*. Then, the amplified sound of each channel is output from the left surround speaker SL (right surround speaker SR).

Figure 6:
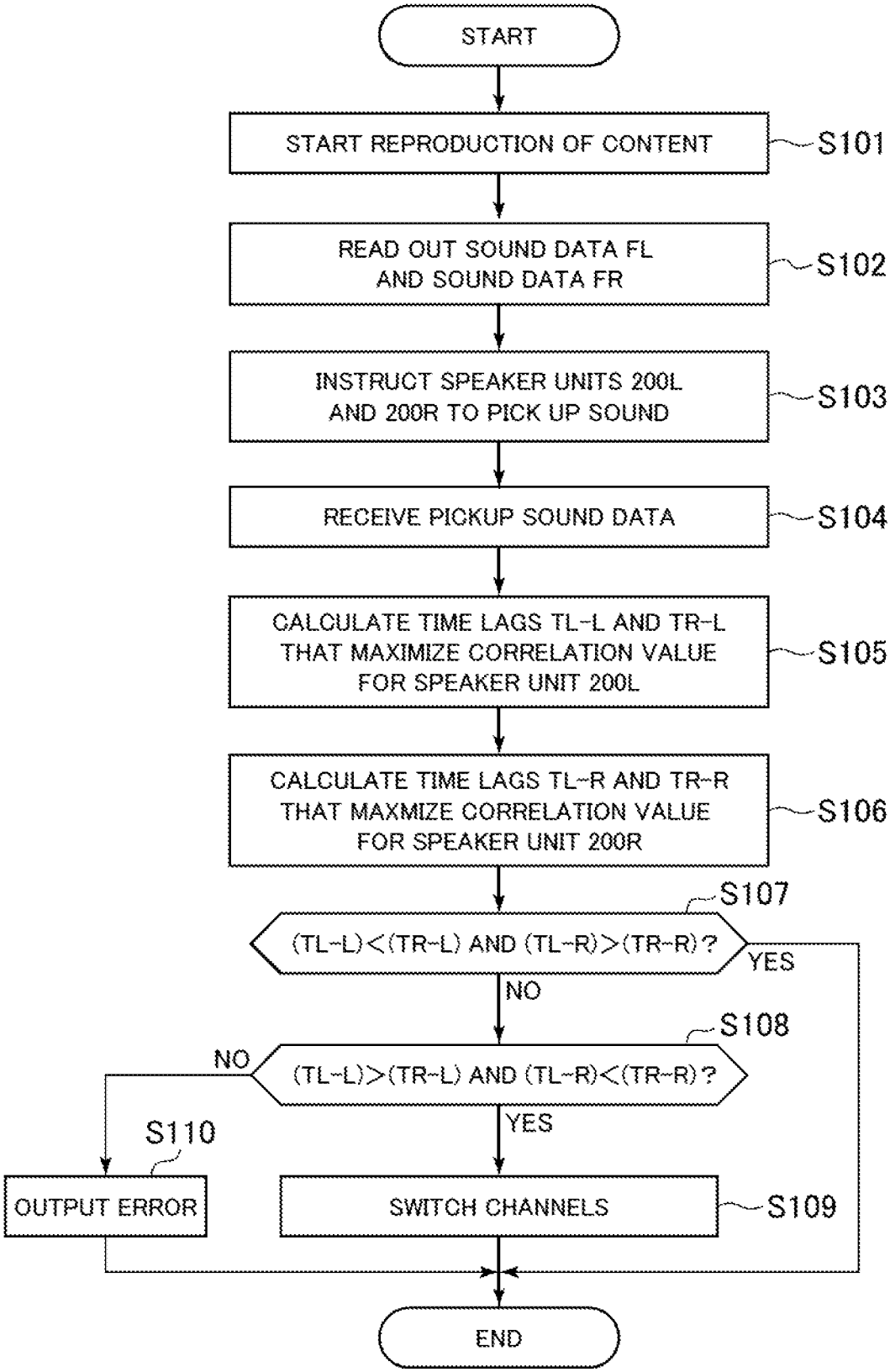
FIG. 6 is a flow chart for illustrating speaker position determination processing to be performed by the audio apparatus.

FIG. 6 is a flowchart for illustrating the speaker position determination processing to be performed by the audio apparatus 100. The processing illustrated in FIG. 6 is executed in accordance with the built-in program of the audio apparatus 100. In this position determination processing, the audio apparatus 100 first starts reproduction of content by the audio output device 101 (Step S101). At this time, only the left front speaker FL and the right front speaker FR may be allowed to emit sounds, and the other speakers may be inhibited from emitting sounds. Subsequently, the calculator 104*b* of the audio apparatus 100 extracts sound data FL on the left front channel FL and sound data FR on the right front channel FR from data on the content (Step S102). The audio apparatus 100 also transmits to the speaker units 200L and 200R a command for instructing the speaker units 200L and 200R to pick up a sound (Step S103). The speaker units 200L and 200R each cause the communication device 205 to receive this command to start the sound pickup by each of the microphone ML and the microphone MR. Then, the speaker units 200L and 200R each transmit the pickup sound data to the audio apparatus 100. The audio apparatus 100 receives pickup sound data L transmitted from the speaker unit 200L, and receives pickup sound data R transmitted from the speaker unit 200R (Step S104). The pickup sound data L and the pickup sound data R, which have been acquired by the reproduction sound acquirer 104*a* through use of the microphones ML and MR, respectively, are acquired in this manner.

The sound data FL and the sound data FR are data for the same timing. Then, the variable $\tau$ that maximizes the cross-correlation function of the pickup sound data L received from the speaker unit 200L and the sound data FL is calculated as a time lag TL-L. In addition, the variable $\tau$ that maximizes the cross-correlation function of the pickup sound data L received from the speaker unit 200L and the sound data FR is calculated as a time lag TR-L (Step S105).

In the same manner, the variable $\tau$ that maximizes the cross-correlation function of the pickup sound data R received from the speaker unit 200R and the sound data FL is calculated as a time lag TL-R. In addition, the variable $\tau$ that maximizes the cross-correlation function of the pickup sound data R received from the speaker unit 200R and the sound data FR is calculated as a time lag TR-R (Step S106).

The determiner 104*c* determines whether or not such a first condition that the time lag TL-L is smaller than the time lag TR-L and the time lag TL-R is larger than the time lag TR-R is satisfied (Step S107). When the first condition is satisfied, a state in which the left surround channel SL is assigned to the speaker unit 200L and the right surround channel SR is assigned to the speaker unit 200R is maintained, and the processing is brought to an end.

Meanwhile, when the first condition is not satisfied, the determiner 104*c* then determines whether or not such a second condition that the time lag TL-L is larger than the time lag TR-L and the time lag TL-R is smaller than the time lag TR-R is satisfied (Step S108). When the second condition is satisfied, the switcher 104*d* assigns the right surround channel SR to the speaker unit 200L, and assigns the left surround channel SL to the speaker unit 200R (Step S109), and the processing is brought to an end. When the second condition is not satisfied as well, the determiner 104*c* displays, for example, an error message "Please check the arrangement of the surround speakers" on the display 102 (Step S110), and the processing is brought to an end.

With the above-mentioned processing, it is possible to determine the positions of the surround speakers without using a microphone having a complicated configuration. In particular, when smart speakers are used as the speaker units 200L and 200R, it is possible to use an existing microphone to determine the positions of those smart speakers.

In this example, the content of music or video is used to determine the position of the speaker, but specific pulse sounds may be emitted from the left front speaker FL and the right front speaker FR in order, and time periods until pickup timings of the specific pulse sounds at the microphones ML and MR may be measured to set the time lags TL-L, TR-L, TL-R, and TR-R.

When the content of music or video is used to determine the position of the speaker, accuracy in detection of a time lag is higher as the sounds output from the left front speaker FL and the right front speaker FR are less similar to each other. In view of this, a segment in which a correlation value between channels of the left front channel FL and the right front channel FR is smaller than a threshold value may be identified to determine the position of the speaker during the segment.

Figure 7:
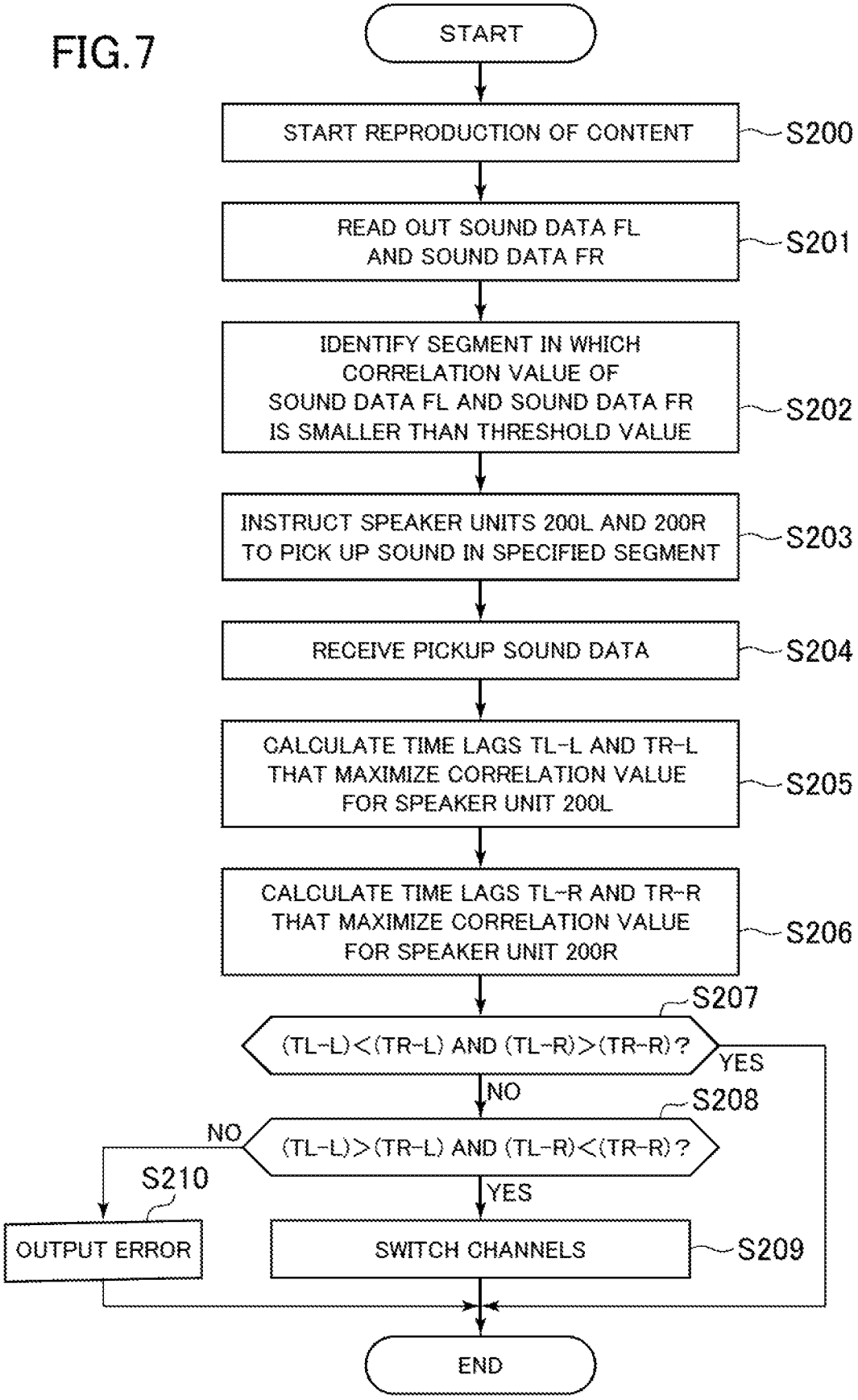
FIG. 7 is a flow chart for illustrating a modification example of the speaker position determination processing to be performed by the audio apparatus.

FIG. 7 is a flow chart for illustrating a modification example of the speaker position determination processing to be performed by the audio apparatus 100. In FIG. 7, the processing of Step S200, Step S201, and Step S207 to Step S210 is the same as the corresponding processing of the flow chart illustrated in FIG. 6, and hence a description thereof is omitted below.

In this modification example, the calculator 104*b* uses the sound data FL and the sound data FR included in the reproduction content, which is read out in Step S201, to identify a segment having a fixed length, in which a cross-correlation value (convolution integral value of the two pieces of sound data with a time lag of zero) is smaller than a threshold value (Step S202). Then, a command is transmitted to the speaker units 200L and 200R so as to pick up the sounds output from the left front speaker FL and the right front speaker FR in the segment and the following segment having a short period of time (Step S203).

In response thereto, the speaker units 200L and 200R use each of the microphones ML and MR in the segment specified by the command to pick up the mixed sound of the reproduction sounds output from the left front speaker FL and the right front speaker FR. Then, the pickup sound data is transmitted to the audio apparatus 100.

In the audio apparatus 100, the reproduction sound acquirer 104*a* acquires the pickup sound data L and the pickup sound data R, which have been acquired through use of the microphones ML and MR (Step S204). Subsequently, the calculator 104*b* of the audio apparatus 100 uses the pickup sound data L and the sound data FL in the segment identified in Step S202 to calculate the time lag TL-L. In addition, the pickup sound data L received from the speaker unit 200L and the sound data FR in the segment identified in Step S202 to calculate the time lag TR-L (Step S205). The calculator 104*b* calculates the time lags TL-R and TR-R for the speaker unit 200R in the same manner (Step S206). According to the above-mentioned processing, when the speaker position determination is performed through use of music, video, or other such freely-selected content, it is possible to improve accuracy of the determination.

The description has been given above of the example in which the respective functions illustrated in FIG. 4 are implemented by the audio apparatus 100, but a part or all of the functions may be implemented by another apparatus. For example, in a smartphone, a tablet computer, or other such portable computer, a part or all of the functions illustrated in FIG. 4 may be implemented. In another case, a part of the functions may be implemented by a server computer on the Internet (for example, a cloud server).

While there have been described what are at present considered to be certain embodiments of the invention, it will be understood that various modifications may be made thereto, and it is intended that the appended claims cover all such modifications as fall within the true spirit and scope of the invention.

What is claimed is:

1. A speaker position determination method, comprising:

acquiring a first reproduction sound output from a first speaker and a second reproduction sound output from a second speaker concurrently with the first reproduction sound, which are picked up by a sound pickup device arranged at a position of a speaker to be determined;

calculating a first time lag indicating a time lag from an output timing of the first reproduction sound until a pickup timing of the first reproduction sound and a second time lag indicating a time lag from an output timing of the second reproduction sound until a pickup timing of the second reproduction sound; and determining the position of the speaker based on the first time lag and the second time lag, wherein the acquiring includes using the sound pickup device to acquire a mixed sound of the first reproduction sound and the second reproduction sound, and wherein the calculating includes, calculating a first position in data of the mixed sound as the first time lag, wherein a first similarity degree indicating a similarity between a piece of data of the first reproduction sound and a piece of data of the mixed sound is maximized when the piece of data of mixed sound is located at the first position, and calculating a second position in data of the mixed sound as the second time lag, wherein a second similarity degree indicating a similarity between a piece of data of the second reproduction sound and the piece of data of the mixed sound is maximized when the piece of data of mixed sound is located at the second position.

2. The speaker position determination method according to claim 1, wherein the first reproduction sound and the second reproduction sound each include any one of sounds of a plurality of channels, which are included in one of music content and video content.

3. The speaker position determination method according to claim 1, wherein the sound pickup device and the speaker, the position of which is to be determined, are provided unitarily with each other.

4. The speaker position determination method according to claim 1, further comprising:

inhibiting the speaker, the position of which is to be determined, from emitting a sound during a period in which a sound is being picked up by the sound pickup device.

5. The speaker position determination method according to claim 1, wherein the first speaker and the second speaker are provided unitarily with each other.

6. The speaker position determination method according to claim 1, further comprising:

switching between a sound to be output from the first speaker and a sound to be output from the second speaker based on the determined position of the speaker.

7. The speaker position determination method according to claim 1, wherein the determining includes comparing the first time lag and the second time lag to determine the position of the speaker based on a result of the comparison.

8. The speaker position determination method according to claim 7, wherein the determining includes determining that the position of the speaker is closer to the first speaker than to the second speaker when the first time lag is smaller than the second time lag.

9. The speaker position determination method according to claim 1, wherein the calculating includes calculating a third similarity degree indicating a similarity between a piece of data of the first reproduction sound and a piece of data of the second reproduction sound, and wherein the determining includes calculating the first similarity degree and the second similarity degree when the third similarity degree is lower than a predetermined value.

10. A speaker position determination system, comprising a server, wherein the server comprises:

a processor configured to:

acquire a first reproduction sound output from a first speaker and a second reproduction sound output from a second speaker concurrently with the first reproduction sound, which are picked up by a sound pickup device arranged at a position of a speaker to be determined;

calculate a first time lag indicating a time lag from an output timing of the first reproduction sound until a pickup timing of the first reproduction sound and a second time lag indicating a time lag from an output timing of the second reproduction sound until a pickup timing of the second reproduction sound; and determine the position of the speaker based on the first time lag and the second time lag, wherein the processor is further configured to:

acquire, via the sound pickup device, a mixed sound of the first reproduction sound and the second reproduction sound; and calculate a first position in data of the mixed sound as the first time lag, wherein a first similarity degree indicating a similarity between a piece of data of the first reproduction sound and a piece of data of the mixed sound is maximized when the piece of data of mixed sound is located at the first first position, and calculate a second position in data of the mixed sound as the second time lag, wherein a second similarity degree indication a similarity between a piece of data of the second reproduction sound and the piece of data of the mixed sound is maximized when the piece of data of mixed sound is located at the second position.

11. The speaker position determination system according to claim 10, wherein the first reproduction sound and the second reproduction sound each include any one of sounds of a plurality of channels, which are included in one of music content and video content.

12. The speaker position determination system according to claim 10, further comprising the sound pickup device provided unitarily with the speaker, the position of which is to be determined.

13. The speaker position determination system according to claim 10, wherein the speaker position determination system is configured to inhibit the speaker, the position of which is to be determined, from emitting a sound during a period in which a sound is being picked up by the sound pickup device.

14. The speaker position determination system according to claim 10, further comprising a speaker unit unitarily including the first speaker and the second speaker.

15. The speaker position determination system according to claim 10, further comprising a switcher configured to switch between a sound to be output from the first speaker and a sound to be output from the second speaker based on the determined position of the speaker.

16. The speaker position determination system according to claim 10, wherein the processor is configured to compare the first time lag and the second time lag to determine the position of the speaker based on a result of the comparison.

17. The speaker position determination system according to claim 16, wherein the processor is configured to determine that the position of the speaker is closer to the first speaker than to the second speaker when the first time lag is smaller than the second time lag.

18. The speaker position determination system according to claim 10, wherein the processor is configured to:

calculate a third similarity degree indicating a similarity between a piece of data on the first reproduction sound and a piece of data on the second reproduction sound; and calculate the first similarity degree and the second similarity degree when the third similarity degree is lower than a predetermined value.

19. An audio apparatus, comprising:

a processor configured to:

acquire a first reproduction sound output from a first speaker and a second reproduction sound output from a second speaker concurrently with the first reproduction sound, which are picked up by a sound pickup device arranged at a position of a speaker to be determined;

calculate a first time lag indicating a time lag from an output timing of the first reproduction sound until a pickup timing of the first reproduction sound and a second time lag indicating a time lag from an output timing of the second reproduction sound until a pickup timing of the second reproduction sound; and determine the position of the speaker based on the first time lag and the second time lag, wherein the processor is further configured to:

acquire, via the sound pickup device, a mixed sound of the first reproduction sound and the second reproduction sound; and calculate a first position in data of the mixed sound as the first time lag, wherein a first similarity degree indicating a similarity between a piece of data of the first reproduction sound and a piece of data of the mixed sound is maximized when the piece of data of mixed sound is located at the first first position; and calculate a second position in data of the mixed sound as the second time lag, wherein a second similarity degree indication a similarity between a piece of data of the second reproduction sound and the piece of data of the mixed sound is maximized when the piece of data of mixed sound is located at the second position.

* * * * *